US011424051B2

(12) United States Patent
Pennell et al.

(10) Patent No.: US 11,424,051 B2
(45) Date of Patent: Aug. 23, 2022

(54) ARMOURED POWER CABLE

(71) Applicant: PRYSMIAN S.P.A., Milan (IT)

(72) Inventors: Richard John Pennell, Eastleigh (GB); Ian Dewi Lang, Eastleigh (GB); Daniel François De Villiers, Eastleigh (GB); Andrew Wynn, Eastleigh (GB)

(73) Assignee: PRYSMIAN S.P.A., Milan (IT)

( * ) Notice: Subject to any disclaimer, the term of this patent is extended or adjusted under 35 U.S.C. 154(b) by 0 days.

(21) Appl. No.: 17/254,049

(22) PCT Filed: Jun. 19, 2018

(86) PCT No.: PCT/EP2018/066276
§ 371 (c)(1),
(2) Date: Dec. 18, 2020

(87) PCT Pub. No.: WO2019/242845
PCT Pub. Date: Dec. 26, 2019

(65) Prior Publication Data

US 2021/0118592 A1 Apr. 22, 2021

(51) Int. Cl.

| | |
|---|---|
| ***H01B 7/22*** | (2006.01) |
| ***H01B 7/14*** | (2006.01) |
| ***H01B 13/26*** | (2006.01) |
| ***H01B 9/02*** | (2006.01) |

(52) U.S. Cl.
CPC ..... *H01B 7/221* (2013.01); *H01B 7/226* (2013.01); *H01B 7/14* (2013.01)

(58) Field of Classification Search
CPC ..... H01B 9/025; H01B 13/26; H01B 7/14; H01B 7/22; H01B 7/221
See application file for complete search history.

(56) References Cited

U.S. PATENT DOCUMENTS

| | | | | |
|---|---|---|---|---|
| 3,351,706 A | | 11/1967 | Gnerre et al. | |
| 4,229,613 A | * | 10/1980 | Braun | B29D 23/001 138/103 |
| 4,674,543 A | * | 6/1987 | Ziemek | H01B 13/26 138/122 |
| 4,803,309 A | | 2/1989 | Marin et al. | |
| 5,072,759 A | * | 12/1991 | Moore | F16L 11/12 138/153 |
| 2012/0024565 A1 | * | 2/2012 | Orini | H01B 7/14 174/106 R |

FOREIGN PATENT DOCUMENTS

| | | | | |
|---|---|---|---|---|
| DE | 24 38 308 A1 | | 2/1976 | |
| GB | 1159428 A | | 7/1969 | |
| GB | 12 00 750 A | | 7/1970 | |
| GB | 1200750 A | * | 7/1970 | H01B 9/026 |
| JP | 6270701 B2 | | 1/2018 | |

* cited by examiner

*Primary Examiner* — Hoa C Nguyen
*Assistant Examiner* — Amol H Patel
(74) *Attorney, Agent, or Firm* — Seed IP Law Group LLP

(57) ABSTRACT

An armoured power cable (10) comprises a cable core (11) and an armour layer (21) comprising a plurality of armouring wires (22) laid around the cable core (11), wherein at least 10% of the armouring wires (22) are wavy wires (23) having a zig-zag shape laying on the outer surface of the cable core (11).

20 Claims, 6 Drawing Sheets

ARMOURED POWER CABLE

TECHNICAL FIELD

The present disclosure relates to armoured power cables.

In particular, the present disclosure relates to armoured power cables for example used in MV (medium voltage) and HV (high voltage) application.

BACKGROUND ART

An armoured power cable is generally employed in application where mechanical stresses are envisaged. In an armoured power cable, the cable core (comprising an electrically conductive element surrounded by an insulating system generally made of an inner semiconductive layer, an insulating layer and an outer semiconductive layer) is surrounded by a metal layer in form, for example, of armouring wires.

In the present description, as "cable core" it is meant an electrically conductive element surrounded by an insulating system generally made of an inner semiconductive layer, an insulating layer and an outer semiconductive layer, also referred to as "insulated core". The cable core usually comprises further layers surrounding the insulated core/s, such as a metallic screen, bedding, water barrier, protective layers.

The armouring wires are designed for providing mechanical protection to the cable core, so as to allow the power cable to withstand high stresses while maintaining a suitable flexibility suitable in, for example, buried application and submarine application.

Typically, an armour is built from metal, generally steel, wires helically wound over the cable core with a certain lay length. As "lay length" it is meant a cable length in which the armouring wire completes one turn around the cable core.

The design of the armour has an important influence on the power cable properties such as bending stiffness, tensional stability and torsion balance.

Helically wound metal wires translate a tensional force into a torsional force trying to twist the cable. In a long lay-length armouring, the wires run almost parallel to the core cable longitudinal axis and can take up tensional forces without building up too much of torsional forces on the cable core. At the same time, a long lay-length increases the bending stiffness of the cable, which is undesirable.

Therefore, typically, the armouring wire lay length is between 10 and 30 times the cable core diameter under the armour.

International standards specify the diameter of the cable armouring wires based on the nominal cross-sectional area of conductors and, where the armour is connected to earth and is used as a circuit protective conductor (CPC), the international standards also specify the armour electric resistance.

Armoured power cables are generally designed to ensure a substantially total circumferential coverage of the cable core, with minimum or no gaps between the armouring wires. This design also ensures that the sheath possibly covering the armour is free from shape inconsistencies.

U.S. Pat. No. 3,351,706 shows an armoured submarine coaxial cable. A layer of equally spaced preformed helical armour wires partially covers the dielectric layer which includes integral, longitudinal ribs. The armour wires cover 50% or less of the of the dielectric layer.

U.S. Pat. No. 4,803,309 discloses a cable where the screen metal wires of a cable are deposited on the core producing relative motion between the wires and the core in alternately different directions circumferentially of the core. The metal wires are spaced one another.

SUMMARY OF THE DISCLOSURE

The Applicant considered that a cable armour should be able to resist to cuts and impact, especially when the armoured power cable is used in directly buried and submarine application.

In this connection, the Applicant has observed that armoured power cables with spaced armour wires, like that disclosed by U.S. Pat. No. 3,351,706, could fail to resist to cutting impact by, e.g., anchoring or fishing gear.

The Applicant noted that gaps among longitudinally extending wires of a cable creates a plurality of parallel fissures between adjacent armouring wires. Such parallel fissures are formed by a succession of oscillating portions wherein each oscillation presents a considerable length. The core cable is thus potentially exposed to damages in case a cutting object hits the armoured power cable along one of such oscillating portion, since the cutting object can directly reach the core cable without being intercepted by any armouring wire.

Accordingly, a cable armour should be made of a number of wires such to encircle the cable core with few or no gaps.

On the other side, the Applicant has observed that the number of armour wires suitable to meet the electrical performance required by certain standards (e.g. BS 5467, 2016, Tables F.2 and F.3) are fewer than the number of wires required to circumferential armour the cable with few or no gaps. Therefore, from an electrical point of view, it is not necessary a complete coverage of the cable core with the armouring wires.

It is apparent that the using less armour wires is appealing because of the cable cost reduction and cable weight reduction, easier to handle and transport.

Cable weight reduction could be achieved by partially replacing armour metal wires with armour polymeric wires, but such materials only provide for a little protection against cutting impacts.

The Applicant has tackled the problem of providing a power cable with an armour made of a number metal wires lower that the number necessary to fully encircle the cable core without impairing the armour mechanical and cutting resistance.

The Applicant has found that by providing a cable with an armour made of metal wires, where at least some of them are zig-zag shaped in a plane laying on the outer surface of the cable core, the number of armour wires needed to cover the cable core decreases, thus reducing the cable cost and weight.

Such an armour comprises zig-zag shaped metal wires with a given peak-to-peak amplitude such that a plurality of gaps are formed in the armour where each gap has limited dimensions. This configuration allows the armour to intercept a cutting object hitting the cable in any direction and to prevent cutting objects from directly reaching the core cable. In this way the armour mechanical and cutting resistance are not impaired.

Accordingly, the present disclosure relates to an armoured power cable comprising a cable core and an armour layer comprising a plurality of metal armouring wires laid around the cable core, wherein at least 10% of the armouring wires are wavy wires having a zig-zag shape laying on the outer surface of the cable core.

The outer surface of the cable core has a generic cylindrical shape. Each zig-zag (i.e. each wave) of the armouring wires extends on a portion of the outer surface of the cable core that can be considered substantially flat when compared to the curvature of the cylindrical outer surface of the cable core.

Throughout this description and in the following claims, the expressions "zig-zag shaped" and/or "wavy" are interchangeably used to indicate a wire having a shape made up of waves.

Throughout this description and in the following claims, the expressions "straight wire" is used to indicate a wire having, before winding, a substantially rectilinear course.

In some embodiments the armour of the cable of the disclosure comprises at most 70% of wavy wires with respect to the total number of armouring wires.

In some embodiments the armour of the cable of the disclosure comprises from 20% to 40% of wavy wires with respect to the total number of armouring wires.

In an embodiment, the armouring wire of the cable of the disclosure have a diameter of from 0.2 mm to 8 mm.

In an embodiment, the armouring wires can be made of a metal such as steel, aluminium, copper, or brass. For example, the armouring wires are made of steel.

In some embodiments, all of the armouring wires have round cross section and substantially the same diameter.

In some embodiment, both the zig-zag shaped wires and straight wires are made starting from the same metal wires.

In an embodiment, all of the armouring wires (zig-zag shaped and straight wires) of the present disclosure are made of metal. In an embodiment, the armouring wires can be steel wires, e.g. galvanized steel wires.

In an embodiment, each of the wavy armouring wires have a wavelength of $(X' \cdot D)+D$ where X' is comprised between 0.5 and 30.0 and D is the diameter of the wavy wire.

In some embodiments, the wavelength of the wavy wires is of $(X' \cdot D)+D$ where X' is comprised between 1.0 and 8.0.

Throughout this description and in the following claims, the expressions "wavelength" when referred to a wavy wire is used to indicate the distance between two successive peaks on the same side of the zig-zag or wavy shape of the wire, along the longitudinal axis of the wavy wire.

The presence of such wavy wires reduces the amount of armouring wires necessary for covering the insulated core cable, since the zig-zag course of the wavy wires creates gaps in the armour.

The mentioned wavelength of the wavy wires defines gap areas avoiding cutting objects from directly reaching the insulated core cable.

In some embodiments, the wavy wires present a peak-to-peak amplitude of $(X'' \cdot D)+D$ where X" is comprised between 0.5 and 5.0 and D is the diameter of the wavy wire. This peak-to-peak amplitude allows the wavy wires to be laid over the cable core by any lay, for example helically or with infinite length lay.

In some embodiments, the peak-to-peak amplitude of the wavy wires is of $(X'' \cdot D)+D$ where X" is comprised between 1.0 and 3.0 and D is the diameter of the wavy wire.

Throughout this description and in the following claims, the expressions "peak-to-peak amplitude" when referred to a wavy wire is used to indicate the width of the zig-zag or wavy shape of the wire perpendicular to the longitudinal axis of the wavy wire.

In some embodiments, each armour wavy wire of the present disclosure has constant wavelength. In some embodiments, each armour wavy wire has constant and peak-to-peak amplitude.

In an embodiment, all of the armour wavy wire of the present disclosure have substantially the same wavelength and/or peak-to-peak amplitude. This allows creating an even gap/material distribution in the armour resulting in an armour with a uniform mechanical and protecting performance.

In the embodiment where all of the armouring wires of the armour layer are zig-zag shaped (or wavy) wires laid parallel each other over the cable core. According to this embodiment, the wavy wires can be helically wound around the cable core or laid with infinite length lay over the cable core, optionally with coincident peaks. In this embodiment, the armour layer can have substantially no gaps among the wires.

In the following of the description, as "infinite length lay" is meant a wire laying substantially parallel to the cable longitudinal axis.

In the embodiment where all of the armouring wires of the armour layer have a zig-zag shape and are laid with infinite length lay, the cable of the present disclosure can further comprise a binder helically wound around the armour layer.

The binder can comprise a tape helically wound around the armour layer or a plurality of strips surrounding the armouring wires and spaced apart along an axial or circumferential direction.

The binder helps to keep in place the rectilinearly laid wavy armouring wire during the manufacturing process. Such a binder is redundant when the armouring wires—either straight or wavy—are helically wound around the cable core.

In some embodiments, the armouring wires are helically wound around the cable core with a lay length at least 10 times the cable diameter.

In the present description and claims, as "lay length" it is meant the length of cable in which the armouring wire completes one turn around the cable.

The helical lay length can be comprised between 0.5 to 10 meters, for example from 1.5 to 6 meters.

In an embodiment, the ratio between the core cable outer diameter and the armouring wire diameter is comprised from 20 to 8, in particular from 15 to 10.

In an embodiment, the armour layer of the cable of the disclosure comprises straight armouring wires and wavy armouring wires helically wound around the cable core and parallel one another in one plane laying on the outer surface of the cable core. The straight wires are helically wound side-by-side leaving substantially no gaps between them.

The succession of wavy and straight armouring wires in the armour layer can be chosen depending on the desired degree of coverage of the cable core and on the particular application of the armoured power cable. For example, after a succession of five straight wires, a wavy wire is provided, followed by another succession of five straight wires.

In some embodiments, a straight wire adjacent side by side to a wavy wire can be in contact with a plurality of successive peaks of the wavy wires. By this configuration, the gaps in the armour are provided between a straight wire and the succession of concavities formed between two successive peaks in contact with the straight wire. Thus, the maximum extension of a gap is limited in the circumferential direction by the peak to peak amplitude and, in the axial direction, by the wavelength of the wavy wire.

In an embodiment, the wavy wires of the present armour layer are prepared by passing a straight wire through a pair of forming gears having suitable profiles suitable to achieve the required zig-zag shape.

In an embodiment, the forming gears are spaced apart to provide for a clearance preventing any wire crush and for avoiding unnecessary wire tensile loading. In an embodiment, the forming gears are not directly driven, whereas the wire to be shaped is pulled through the forming gears.

In an embodiment, the manufacturing process of the cable of the present disclose comprises the following stages. The cable core is unrolled from a drum where pay-off equipment drives the drum such that the cable core is rotated around its longitudinal axis. The required number of armour wires are paid off from individual spools and pass through banks of tensioning pulleys including the forming gears for shaping the wavy wires. The armour wires are then passed through a grouping die and helically wound onto the cable core. The now armoured cable core is hauled off using a device such as a caterpillar. The hauling off mechanism and the take-up equipment are driven in synchronisation with the drum.

The armoured cable can be then sheathed by extruding a polymeric layer onto the armour layer.

In the embodiment where all of the armouring wires of the armour layer have a zig-zag shape and are laid with infinite length lay, the complexity of cable manufacturing process can be greatly reduced since there is no need to rotate the cable core during the cable core unrolling stage.

BRIEF DESCRIPTION OF THE DRAWINGS

The present cable will be now described more fully hereinafter with reference to the accompanying drawings, in which some, but not all embodiments of the cable are shown.

Drawings illustrating the embodiments are not to scale representations.

For the purpose of the present description and of the appended claims, use of the "a" or "an" are employed to describe elements and components of the disclosure. This is done merely for convenience and to give a general sense of the disclosure. This description should be read to include one or at least one and the singular also includes the plural unless it is obvious that it is meant otherwise.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein.

Figure 1:
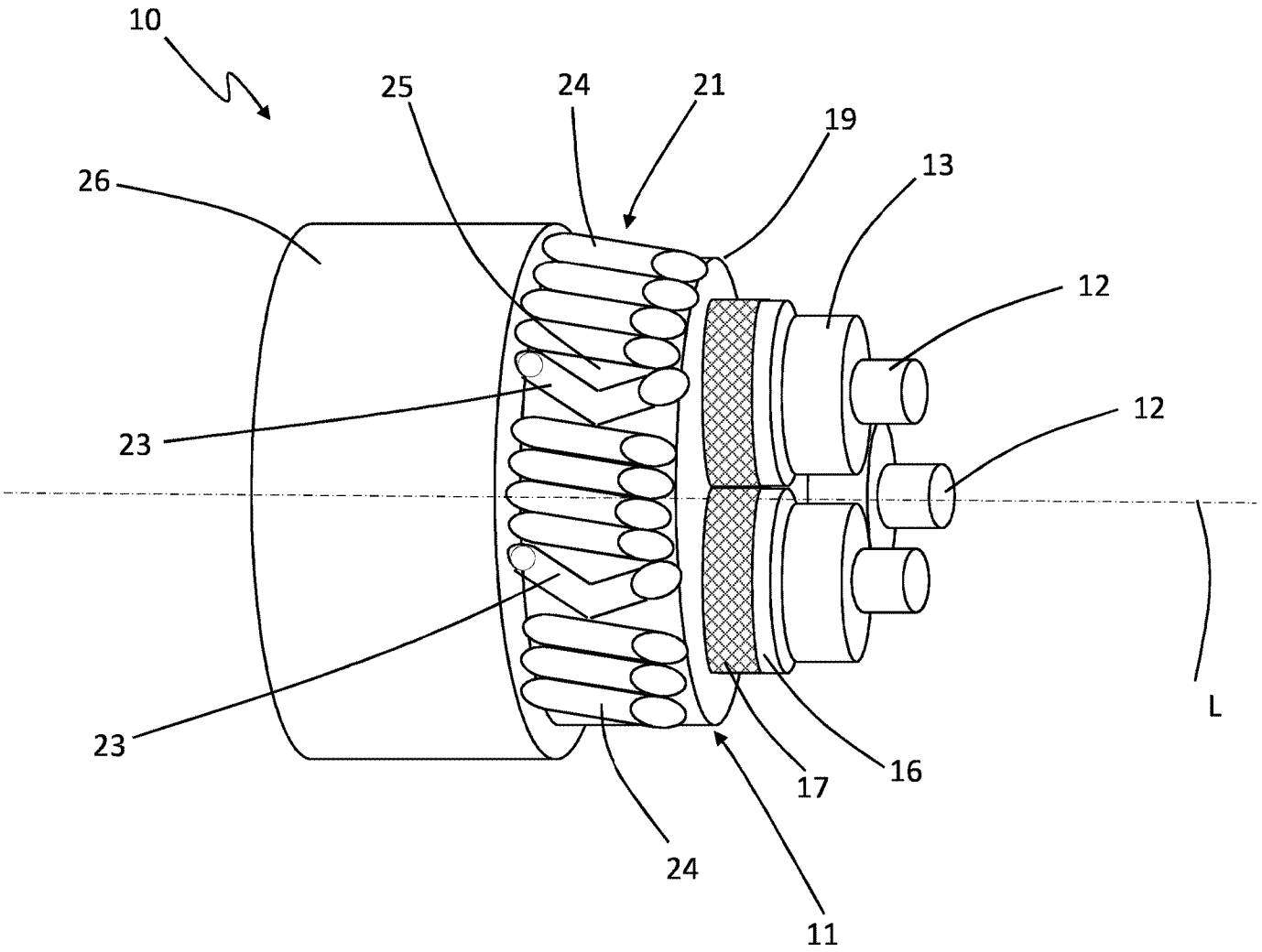
Figure 2:
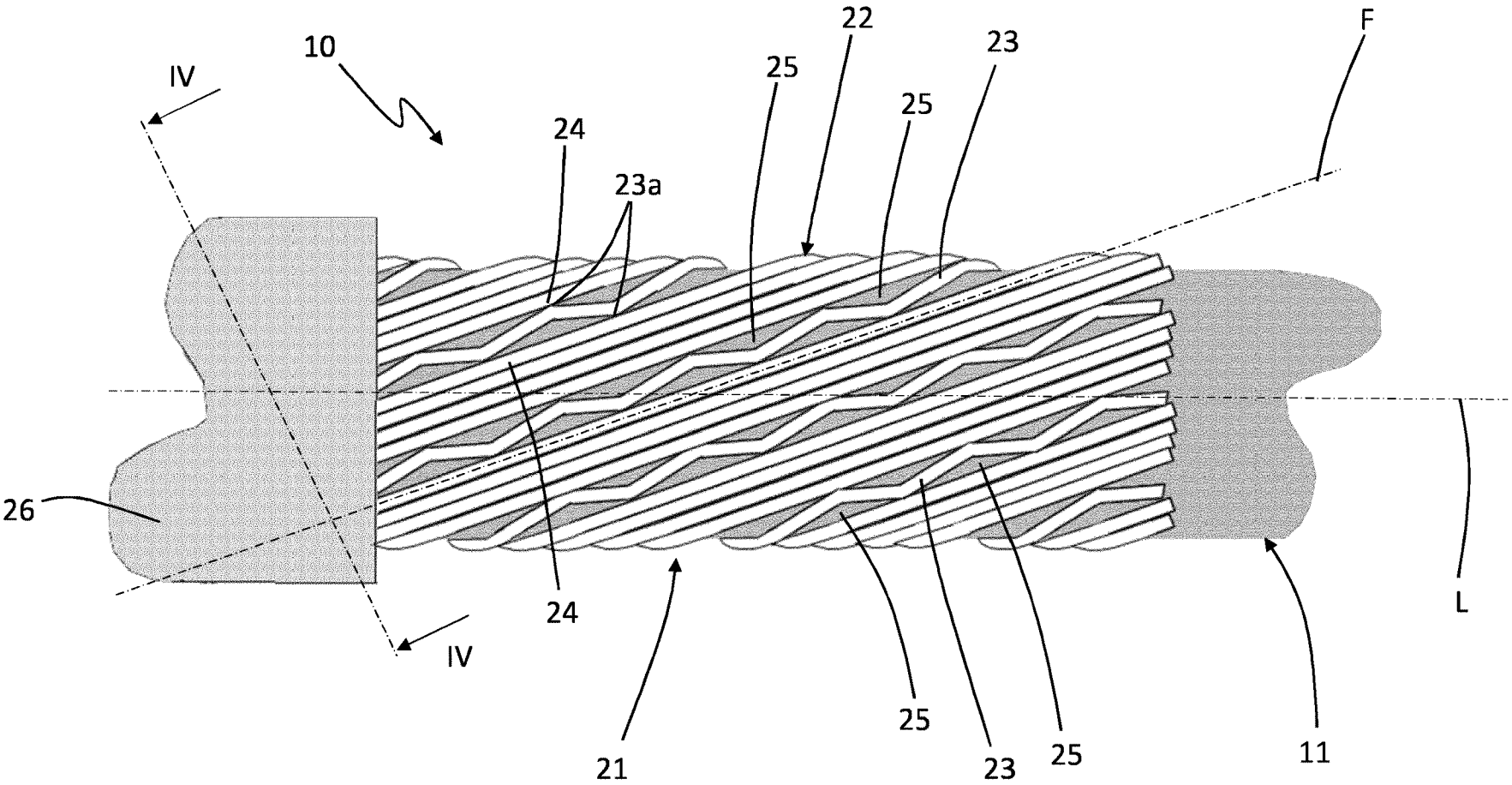
Figure 3:
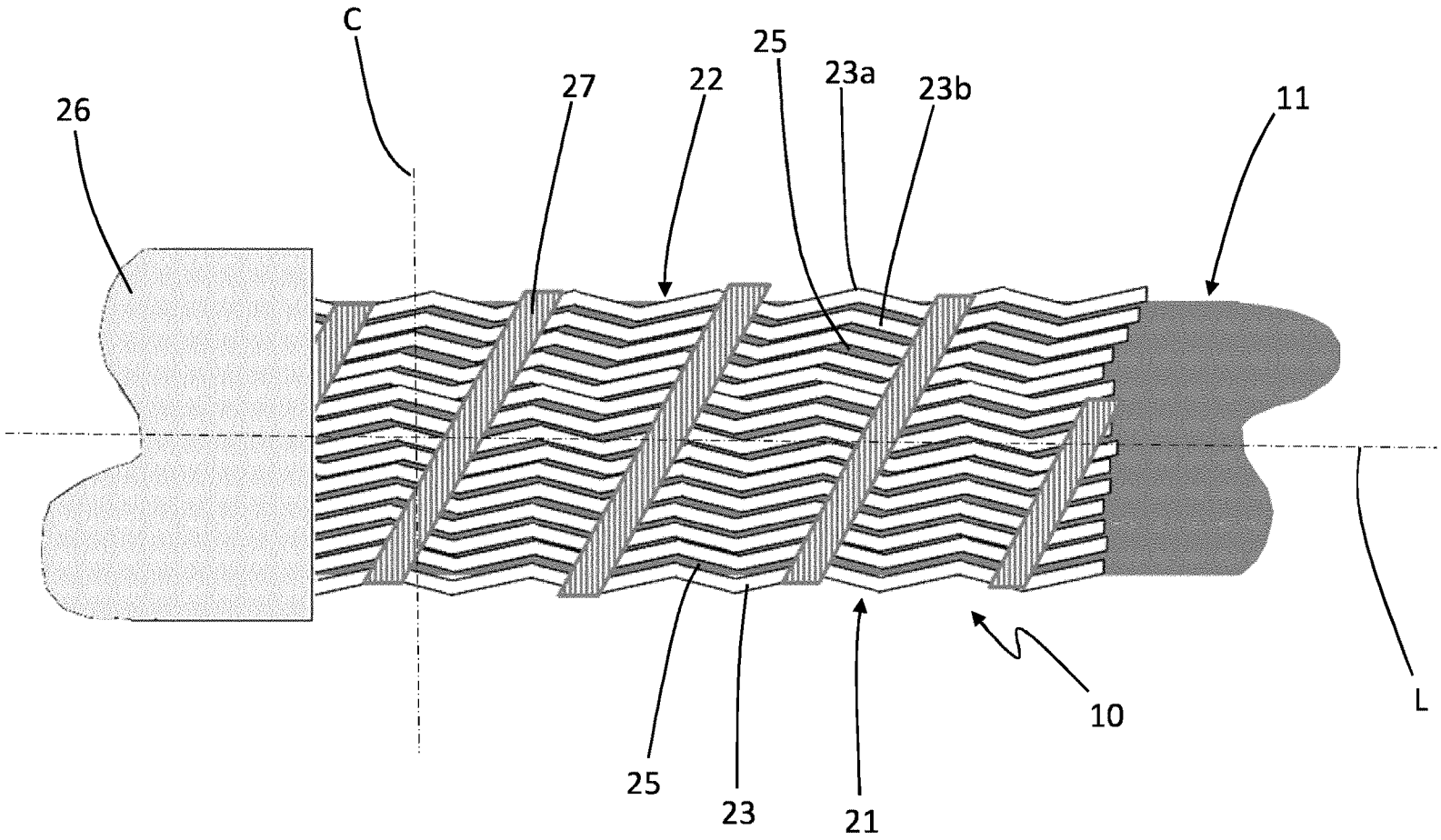
Figure 4:
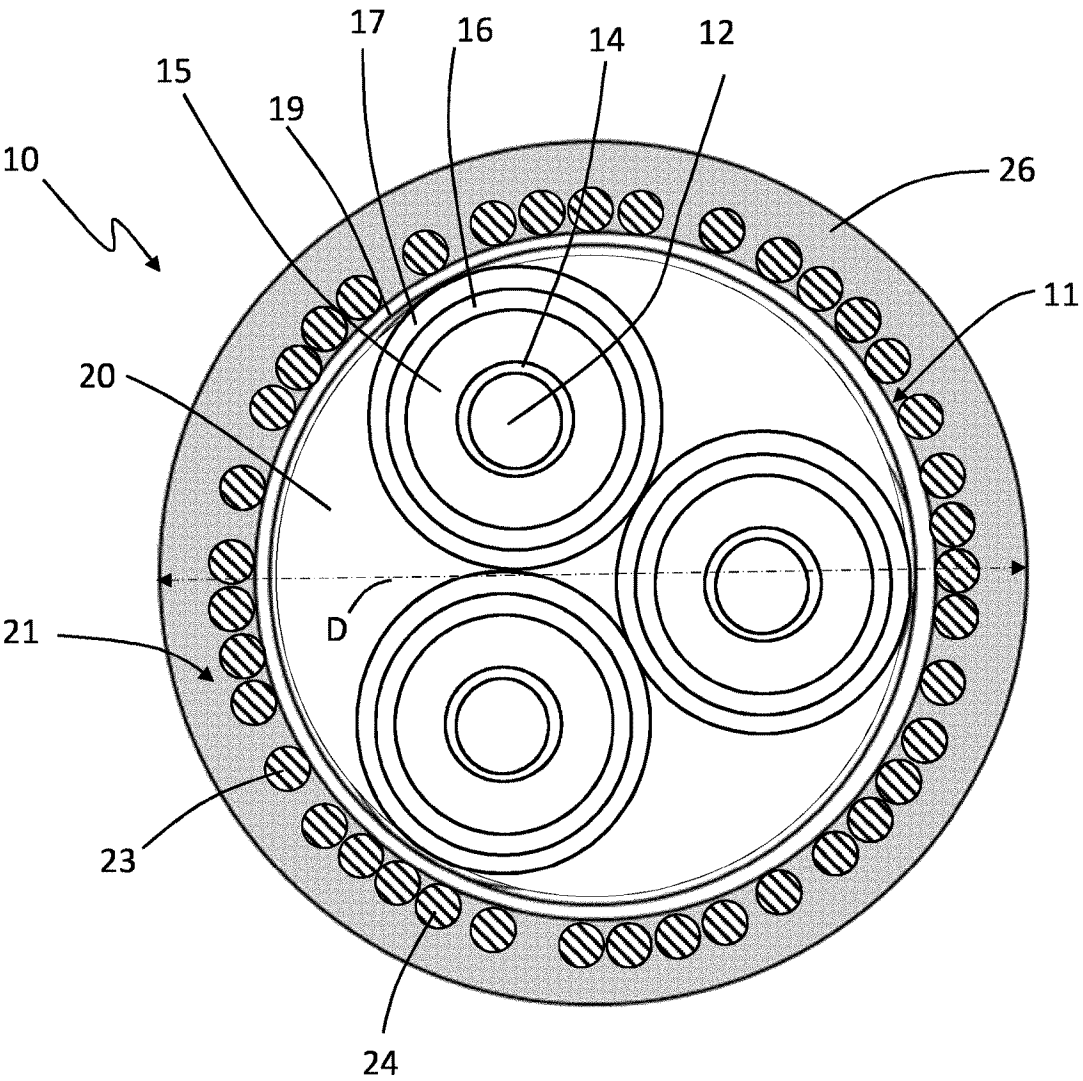
Figure 5:
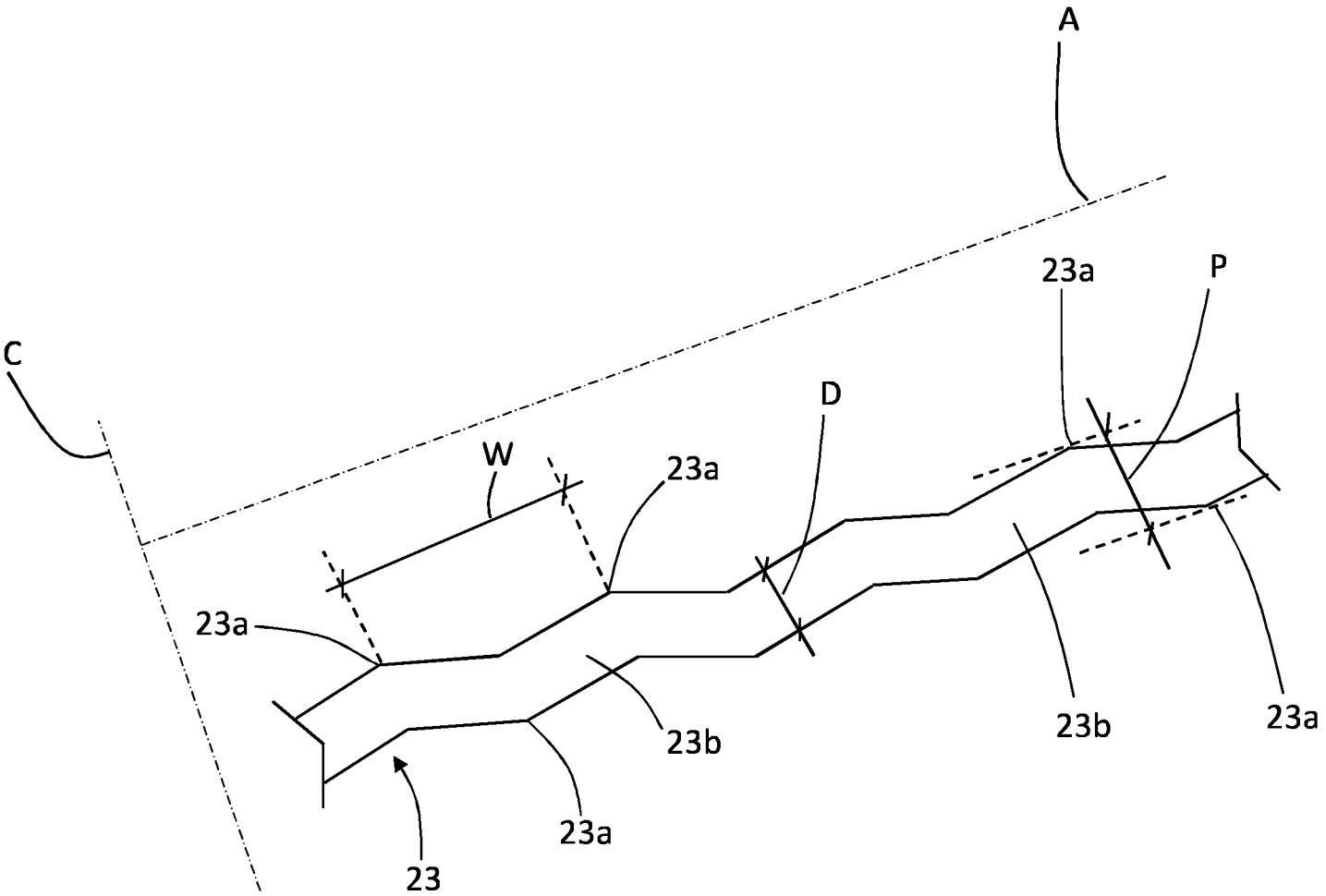
Figure 6:
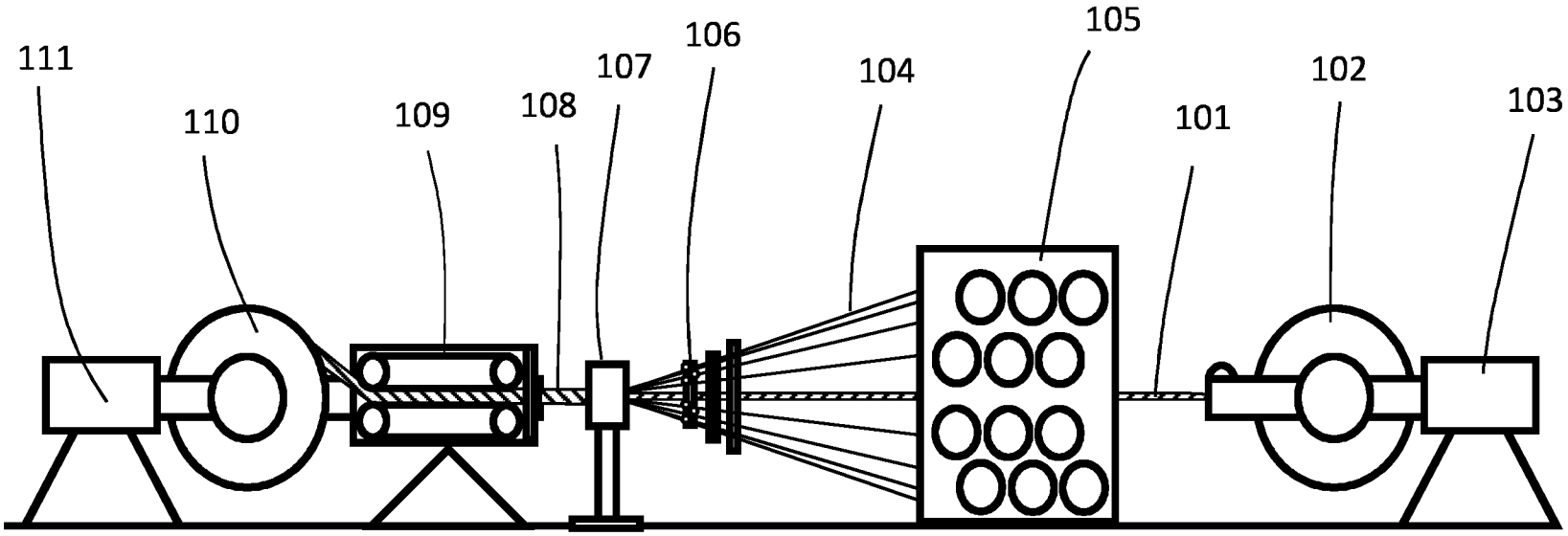

FIG. 1 shows a schematic perspective view of an armoured power cable according to the present disclosure;

FIG. 2 shows a schematic lateral view of an embodiment of an armoured power cable according to the present disclosure;

FIG. 3 shows a schematic lateral view of another embodiment of an armoured power cable according to the present disclosure;

FIG. 4 shows a schematic cross section along the plane Iv-Iv of the armoured power cable of FIG. 1;

FIG. 5 show a magnified view of a detail of the armoured power cable of FIG. 2; and FIG. 6 shows a manufacturing line of the cable of the present disclosure.

DETAILED DESCRIPTION

An armoured power cable according to the present disclosure is indicated with the reference number 10 in FIG. 1.

As illustrated in FIG. 1, the armoured power cable 10 comprises a cable core 11 for carrying direct current or alternate current and extending along a longitudinal direction L.

The cable core 11 comprises three electric conductors 12 made of an electrically conductive metal, such as copper or aluminium or both, in form, as an example, of a rod, stranded wires, profile wire or segmental conductor.

The electric conductor 12 is surrounded by an insulating system 13 which can comprise an inner semiconducting layer 14, an insulating layer 15 and an outer semiconducting layer 16 (illustrated in FIG. 4).

The inner semiconducting layer 14, the insulating layer 15 and outer semiconducting layer 16 can be made of extrudable polymeric materials, such as polyethylene, crosslinked polyethylene (XLPE), ethylene propylene rubber (EPR) or a propylene compound. The material of the inner and of the outer semiconducting layers 14, 16 are added with a conductive filler, such as carbon black. Alternatively, the insulating layer 15 can be made of paper or paper-polypropylene tapes impregnated with suitable viscosity oil.

The cable core 11 further comprises a metallic screen 17 surrounding the insulating system 13, as illustrated in FIGS. 1 and 4.

The metallic screen 17 can be made of lead alloy or copper or aluminium in form of tape, wires or braids.

The three conductor 12 with their relevant insulating system 13 are stranded and embedded in a bedding or interstitial filler material 20 (FIG. 4), made, for example, of extrudable polymeric material or of fibrous material.

The bedding 20 is surrounded by a protecting layer 19 which can be composed by one or more sub-layers such as a water barrier made of metal or a composite polymer/metal, polyester tapes.

Over the cable core 11 it is provided an armour layer 21 comprising a layer of a plurality 22 of metal armouring wires. In some embodiments, the plurality of metal armouring wires is made of steel.

In the present embodiment, each of the plurality of metal armouring wires 22 has a minimum tensile strength of 125 $N/mm^2$. When an armouring wire of the plurality 22 is a galvanized steel wire, it has an electric resistance less than 3.0 ohm/Km; this compares with the cable specification for the armouring wire of the plurality 22 made of a drawn metal, which has a required electric resistance less than 4.0 ohm/Km.

The armouring wires of the plurality 22 have a constant circular cross section.

A jacket 26 surrounds the armoured layer 21. The jacket 26 can be made of polypropylene yarns or high density polyethylene.

According to the present disclosure, at least 10% of the armouring wires of the plurality 22 are wavy wires 23 zig-zag shaped in a plane laying on the outer surface of the cable core 11. The other armouring wires of the plurality 22 are straight wires 24

The wavy wires 23 can have a substantially sinusoidal shape or a substantially triangular wave shape. The specific shape of the wavy wires 23 depends on the process for manufacturing the wavy wires 23, as will be discussed hereinafter.

As detailed in FIG. 5, a wavy wire 23 comprises a succession of peaks 23*a*, at which the wavy wire 23 course changes direction. The peaks 23*a* are evenly distributed along the longitudinal axis A of the wavy wire 23. Two successive peaks 23*a* are connected by a connecting portion 23*b* having an arcuate or straight shape.

A wavy wire 23 has a wavelength W, a peak to peak amplitude P and a diameter D.

In an embodiment, all the wavy wires 23 have substantially the same wavelength W which is thus constant along each wavy wire 23.

In an embodiment, all the wavy wires 23 have the substantially same peak to peak amplitude P which is thus constant along each wavy wire 23.

In an embodiment, the plurality of armouring wires 22 amount to from 15 to 60 armouring wires 23, 24, in particular from 24 to 44 armouring wires 23, 24.

In the embodiment of FIG. 2 the plurality of metal armouring 22 are helically wound around the cable core 11 along a winding direction F. The plurality 22 comprises both wavy wires 23 and straight wires 24 which are helically wound with the same lay length.

A group of four straight wires 24, adjacent and substantially in direct contact one another, alternate to one wavy wire 23.

In an embodiment, as illustrated in FIG. 2, the peaks 23*a* of each wavy wire 23 are in direct contact with two straight wires 24 belonging to different groups of four. By this configuration of the plurality 22 of armouring wires, gaps 25 in the armour layer 21 are formed between a wavy wire 23 and two straight wires 24.

A sequence of gaps 25 extends along the wire winding direction F. The dimension of each gap 25 is given by the wavelength W and the peak amplitude P of each wavy wire 23.

In the embodiment of FIG. 3, the plurality 22 of armouring wires comprises only wavy wires 23. All the wavy wires 23 extend parallel each other along the cable longitudinal direction L and they do not overlap each other, while contacts among them could allow dissipation of current.

By this configuration of wavy wires 23, the gaps 25 in the armour 21 can be formed between adjacent wavy wires 23, as illustrated in FIG. 3.

In the illustrated embodiment, the peaks 23*a* of adjacent wavy wires 23 are slightly misaligned in the circumferential direction C, so as the connecting portions 23*b* of adjacent wavy wires 23. Some contact points for dissipating current are present In an alternative embodiment, not illustrated, the peaks 23*a* of adjacent wavy wires 23 can be aligned in the circumferential direction C, and the connecting portions 23*b* of adjacent wavy wires 23 are substantially parallel each other. In this embodiment, substantially no gaps are present in the armoured layer 21 and the contact for dissipating current is more extended.

In the embodiment of FIG. 3, the wavy wires 23 are held in position by a binder 27 in form of a continuous tape helically wound over the armouring wires 23.

The cable of the present disclosure where the armouring wires are helically wound around the cable core can be manufactured by a line as from FIG. 6.

The cable core 101 is unwound from a drum 102 held in a pay-off stand 103. The pay-off stand 103 drives the drum 102 such that the cable core 100 is rotated perpendicular to the axis of the manufacturing line. The required number of metal armouring wires 104 are paid off from individual spools 105. The armouring wires 104 pass through banks of tensioning pulleys 106 which include the forming gears for shaping some straight armouring wire into wavy wire.

In particular, the wavy wires can be manufactured by passing a straight wire through a clearance provided between two forming gears. The teeth profile of the two gears, as well as their diameters, are substantially identical. The distance that divides the two gears (clearance), is set to allow the teeth of the two gears to engage each other without causing undue stress to the wire. When a straight wire pass through the clearance between the two gears, the teeth of the gears plastically deform it and provided a zig-zag shaped (or wavy) wire. The shape of the corrugation depends on the profiles of the teeth.

The armouring wires are then pass through a grouping die 107 and helically wound around the cable core 102 resulting in an armoured cable 108. The armoured cable 108 is hauled off using a device 109 such as a caterpillar. The haul off device 109, the take-up drum 110, and the take-up stand 111 are turned around the circumference of the cable at the same speed and direction of with the pay-off drum 102.

The cable of the present disclosure where the armouring wires are all wavy wires laid with infinite length lay around the cable core (parallel to the longitudinal cable axis) can be manufactured by a line analogous to that of FIG. 6 having the following differences: a) the pay-off stand 103 driving the drum 102 does not rotate the cable core; b) a delivering device for providing the armoured cable 108 of a binder can be optionally provided before the haul off device 109.

The armoured cable 108 can be directly covered with a polymeric jacket by extrusion.

The invention claimed is:

1. An armoured power cable comprising a cable core and an armour layer comprising a plurality of armouring wires laid around the cable core, wherein the plurality of armouring wires include a first plurality of straight wires and a second plurality of wavy wires, and at least 10% of the armouring wires are wavy wires having a zig-zag shape laying on an outer surface of the cable core.

2. The armoured power cable according to claim 1, wherein the armour layer comprises from 20% to 40% wavy wires with respect to a total number of the armouring wires.

3. The armoured power cable according to claim 1, wherein each wavy wire has substantially constant peak-to-peak amplitude (P) and wavelength (W), and a diameter (D).

4. The armoured power cable according to claim 3, wherein each wavy wire has a wavelength (W) of (X'·D)+D, where X' is a value between 0.5 and 30.0 and D is a diameter of the wavy wire.

5. The armoured power cable according to claim 3, wherein each wavy wire has a peak-to-peak amplitude (P) of (X"·D)+D where X" is a value between 0.5 and 5.0 and D is a diameter of the wavy wire.

6. The armoured power cable according to claim 1, wherein all of the wavy wires have substantially constant peak-to-peak amplitude (P) and wavelength (W).

7. The armoured power cable according to claim 1, wherein the armouring wires are made of metal.

8. The armoured power cable according to claim 1, wherein the wavy wires are laid with infinite length lay over the cable core.

9. The armoured power cable according to claim 8 comprising a binder around the armour layer.

10. The armoured power cable according to claim 1, wherein the plurality of armouring wires each has a diameter ranging from 0.2 mm to 8 mm.

11. The armoured power cable according to claim 1, wherein the plurality of armouring wires have substantially a same diameter.

12. The armoured power cable according to claim 1, wherein the plurality of armouring wires each has a round cross section.

13. An armoured power cable comprising a cable core and an armour layer comprising a plurality of armouring wires laid around the cable core, wherein the armour layer includes from 20% to 40% wavy wires with respect to a total number of the armouring wires, the wavy wires having a zig-zag shape laying on an outer surface of the cable core.

14. The armoured power cable according to claim 13, wherein each wavy wire has substantially constant peak-to-peak amplitude (P) and wavelength (W), and a diameter (D).

15. The armoured power cable according to claim 14, wherein each wavy wire has a wavelength (W) of (X'·D)+D, where X' is a value between 0.5 and 30.0 and D is a diameter of the wavy wire.

16. The armoured power cable according to claim 14, wherein each wavy wire has a peak-to-peak amplitude (P) of (X"·D)+D where X" is a value between 0.5 and 5.0 and D is a diameter of the wavy wire.

17. The armoured power cable according to claim 13, wherein all of the wavy wires have substantially constant peak-to-peak amplitude (P) and wavelength (W).

18. The armoured power cable according to claim 13, wherein the armouring wires are made of metal.

19. The armoured power cable according to claim 13, wherein all of the armouring wires are wavy wires laid parallel to one another over the cable core.

20. The armoured power cable according to claim 13, wherein the plurality of armouring wires each has a round cross section.

* * * * *